US005709375A

United States Patent [19]

Klopfenstein

[11] Patent Number: 5,709,375

[45] Date of Patent: Jan. 20, 1998

[54] SHEET MATERIAL COLLATING SYSTEM

[75] Inventor: Andrew L. Klopfenstein, Tipp City, Ohio

[73] Assignee: Heidelberg Finishing Systems, Inc., Dayton, Ohio

[21] Appl. No.: 719,997

[22] Filed: Sep. 25, 1996

[51] Int. Cl.[6] ..... B65H 39/00

[52] U.S. Cl. ..... 270/52.26; 270/52.3

[58] Field of Search ..... 270/52.3, 52.26, 270/52.2; 198/465.2, 465.3, 803.14

[56] References Cited

U.S. PATENT DOCUMENTS

| | | | |
|---|---|---|---|
| 778,637 | 12/1904 | Cottrell . | |
| 3,711,083 | 1/1973 | Cantrell, Sr. . | |
| 4,555,101 | 11/1985 | Stobb | 270/52.26 |
| 4,699,266 | 10/1987 | Weiss | 198/465.3 |
| 4,723,770 | 2/1988 | Seidel et al. . | |
| 4,941,563 | 7/1990 | Fahrion | 198/265.3 |
| 4,971,189 | 11/1990 | Fleming et al. | 198/465.2 |
| 4,974,519 | 12/1990 | Miletto | 198/465.2 |
| 5,292,110 | 3/1994 | Honegger | 270/52.26 |
| 5,299,680 | 4/1994 | Rhodes | 198/465.2 |

*Primary Examiner*—John T. Kwon

*Attorney, Agent, or Firm*—Tarolli, Sundheim, Covell, Tummino & Szabo

[57] ABSTRACT

A sheet material collating system includes a pair of tubular metal guide rails. A plurality of plastic carriers are supported by guide rollers on the guide rails. A plurality of plastic pockets for receiving signatures are supported on the carriers in a position cantilevered out from the guide rails. Each carrier has a set of drive teeth. Drive element located along the guide rails includes an externally toothed drive belt which is engageable with the drive teeth on the carriers, as the carriers move past the drive element, to drive the carriers and thereby the pockets along the guide rails.

15 Claims, 4 Drawing Sheets

SHEET MATERIAL COLLATING SYSTEM

BACKGROUND OF THE INVENTION

1. Technical Field

The present invention relates to a sheet material handling apparatus. In particular, the present invention relates to an apparatus for carrying sheet material handling devices, such as pockets or saddles for signatures, in a collating system.

2. Description of the Prior Art

A known sheet material collating system includes a plurality of pockets which are supported for movement on a conveyor chain past a plurality of signature feed mechanisms. Each one of the signature feed mechanisms deposits a signature into a pocket travelling underneath the feed mechanism. In this manner, collated assemblages of signatures are formed in the pockets. The pockets are subsequently opened to allow the collated assemblages of signatures to drop out of the pockets for further handling.

SUMMARY OF THE INVENTION

The present invention is a sheet material handling apparatus comprising an elongate guide rail, a plurality of interconnected carriers supported on a first side of the guide rail for movement in a first direction along the guide rail, and a plurality of sheet material receivers for receiving and supporting sheet material. Each one of the receivers is connected with and movable with a respective one of the carriers. The carriers are disposed intermediate the receivers and the guide rail. The receivers are cantilevered out from the guide rail in a second direction transverse to the first direction.

In a preferred embodiment, each one of the carriers has a drive surface. The apparatus comprises drive means including a drive member engageable with the drive surfaces on the carriers for moving the carriers and thereby the receivers in the first direction along the guide rail.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF A PREFERRED EMBODIMENT

Figure 1:
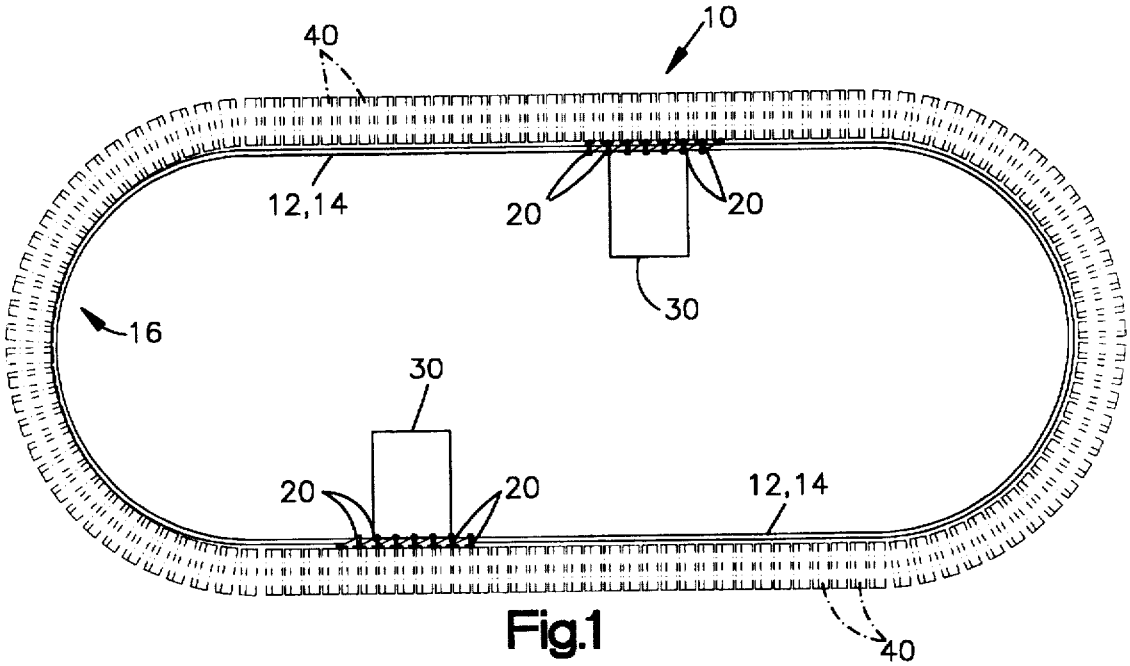
FIG. 1 is a schematic illustration of a sheet material collating system constructed in accordance with the present invention.

The present invention relates to a sheet material handling apparatus. In particular, the present invention relates to a collating system for sheet material such as signatures. As representative of the present invention, FIG. 1 illustrates a sheet material collating system 10.

Figure 2:
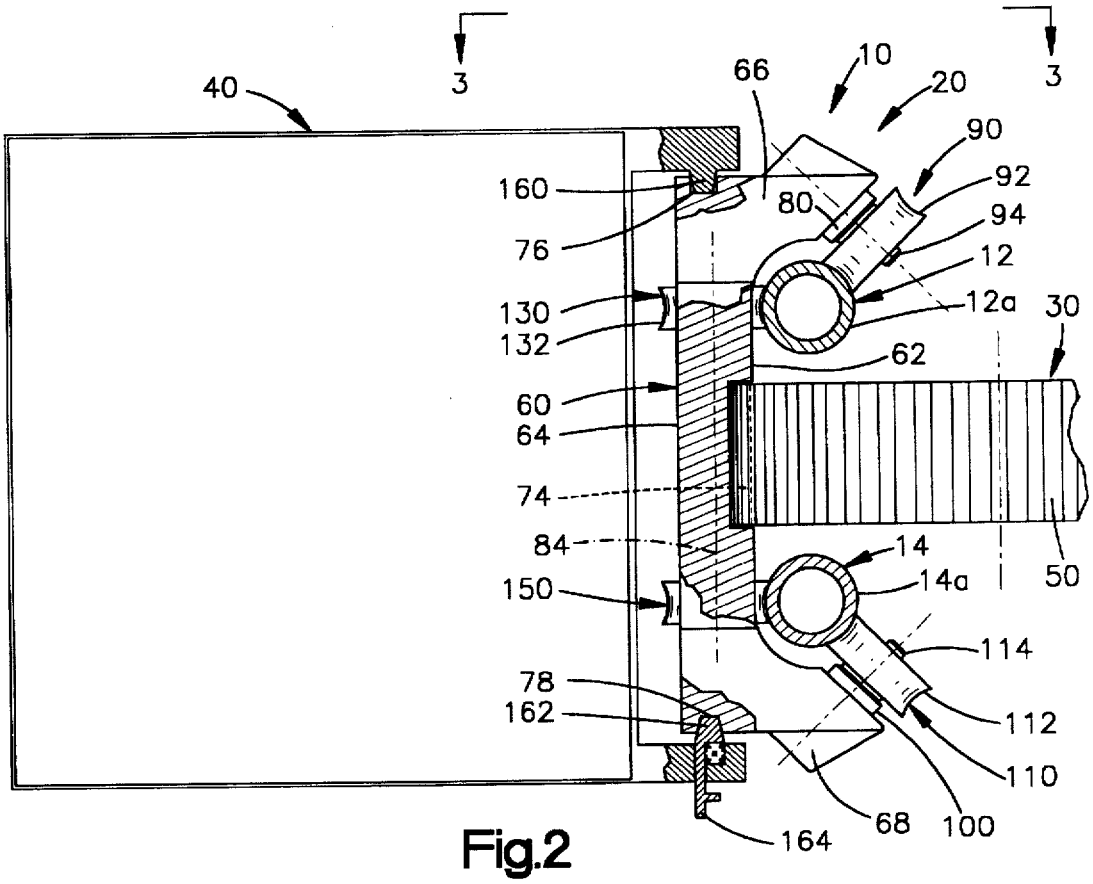
FIG. 2 is an elevational view, partially in section, of a portion of the system of FIG. 1 showing a drive unit in engagement with a carrier supporting a pocket.
Figure 5:
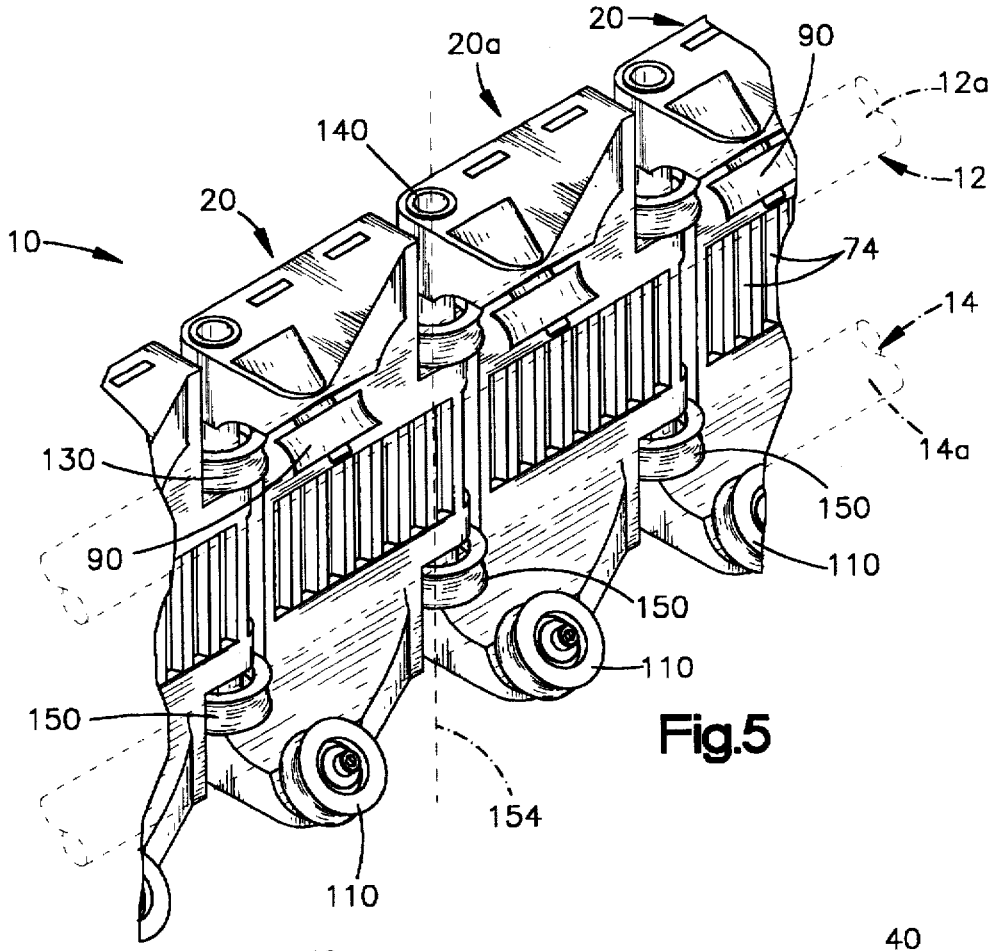
FIG. 5 is a perspective view showing several interconnected carriers.
Figure 6:
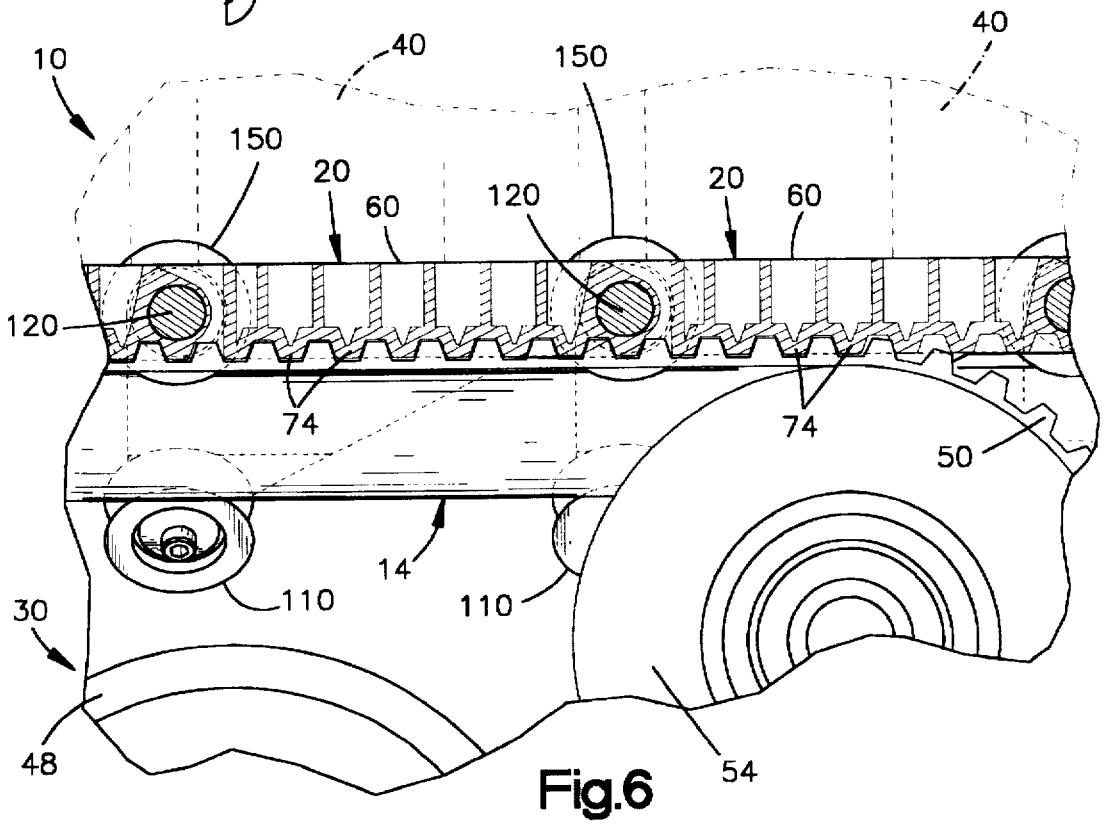
FIG. 6 is an enlarged view, partially in section, of a portion of the system.

The collating system 10 includes upper and lower guide rails 12 and 14 (FIGS. 2 and 5). The collating system 10 also includes a plurality of carriers 20 which are interconnected and supported for movement along the rails 12 and 14, and one or more drive units 30 for driving the carriers along the rails. A plurality of sheet material receivers, such as pockets 40 for holding sheet material, such as signatures, are supported on the carriers 20 for movement with the carriers along the rails 12 and 14.

The guide rails 12 and 14 are preferably made from tubular steel having a cylindrical cross-sectional configuration. The guide rails 12 and 14 have cylindrical outer surfaces 12*a* and 14*a*, respectively. The guide rails 12 and 14 extend parallel to each other at a fixed, predetermined distance from each other. Although the guide rails 12 and 14 are shown in the drawings as extending in a single plane in a closed, oval-shaped loop 16, it should be understood that the rails could extend in more than one plane and/or could extend in other configurations.

The drive units 30 (FIG. 1) are located adjacent to the guide rails 12 and 14. A sufficient number of drive units 30 are provided to ensure proper movement of the interconnected carriers 20 along the rails 12 and 14. The drive units 30 are placed at desired locations along the loop 16. In the illustrated embodiment, two identical drive units 30 are spaced apart on opposite sides of the loop 16.

Figure 3:
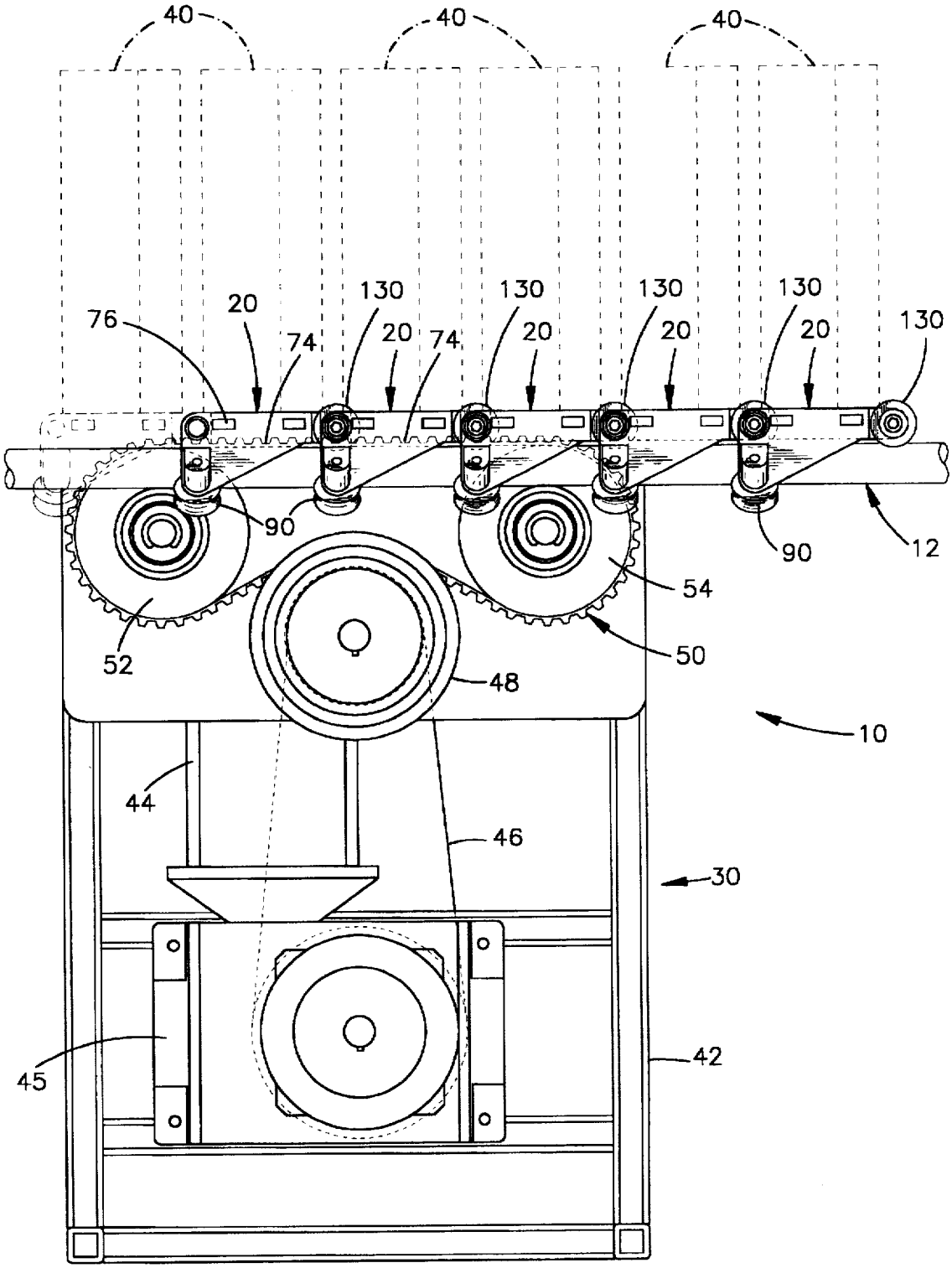
FIG. 3 is a plan view of a portion of the system of FIG. 1 showing a drive unit in engagement with a plurality of carriers each supporting a pocket.

Each drive unit 30 (FIG. 3) includes a frame 42 which is fixed in position adjacent to the rails 12 and 14. An electric motor 44 is mounted on the frame 42. The electric motor 44 transmits power through a gearbox 45 and a flexible drive member 46, such as a V-belt or chain, to an externally toothed drive wheel 48.

Each drive unit 30 includes an externally toothed drive belt 50 (FIG. 3) which extends in a closed loop configuration around two pulleys 52 and 54. On one side of the closed loop configuration the drive belt 50 engages and is driven by the drive wheel 48. On the other side of the closed loop configuration the drive belt 50 is engageable with the carriers 20, in a manner described below, to drive the carriers, and thus the pockets 40, along the rails 12 and 14.

Figure 4:
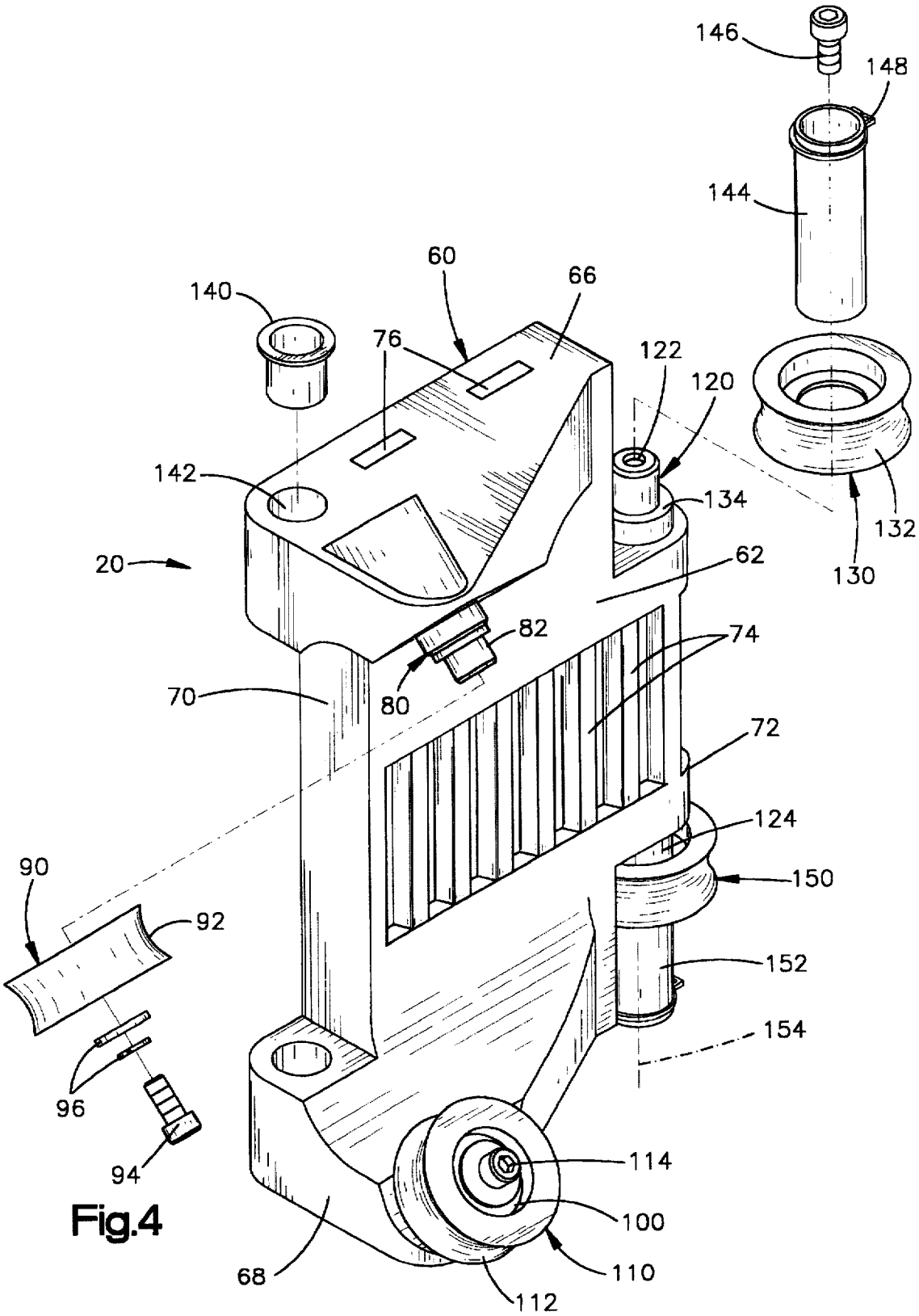
FIG. 4 is an exploded perspective view of one of the carriers.

Each carrier 20 (FIG. 4) includes a carrier body 60. The carrier body 60 is preferably made as one piece from an engineering plastic composite material, such as glass fiber reinforced plastic, such as nylon 6/6 with 50% long glass. The carrier body 60 has a generally planar, box-shaped overall configuration including opposite inner and outer major side surfaces 62 and 64 and opposite upper and lower portions 66 and 68. The carrier body 60 also has opposite first and second end portions 70 and 72.

A series of drive teeth 74 are formed on the carrier body 60. Each one of the drive teeth 74 extends vertically along the inner major side surface 62 of the carrier body 60. The drive teeth 74 are spaced along the length of the carrier body 60, between the first and second end portions 70 and 72 of the carrier body.

A pair of upper pocket mounting openings 76 are formed in the upper end portion 66 of the carrier body 60. A pair of lower pocket mounting openings 78 (FIG. 2) are formed in the lower end portion 68 of the carrier body 60.

An upper carrier wheel insert 80 (FIG. 4) is insert molded in the first end portion 70 of the carrier body 60, at a location above the drive teeth 74. The carrier wheel insert 80 is made from a material such as aluminum. The carrier wheel insert 80 has an internally threaded end portion 82 which projects from the carrier body 60. The end portion 82 extends at an angle of 45° relative to a base plane 84 of the carrier body 60.

An upper drive side guide roller 90 is supported for rotation on the carrier wheel insert 80. The roller 90 is molded from a resilient material, such as polyurethane, and has a concave outer rolling surface 92. A sealed ball bearing (not shown) is molded into the roller 90. The roller 90 is fixed for movement with the outer race of the bearing.

A bolt 94 is threaded into the end portion 82 of the carrier wheel insert 80. The bolt 94 and a pair of washers 96 secure the inner race of the bearing to the insert 80. The upper drive side guide roller 90 is thereby journalled for rotation relative to the carrier body 60.

A lower carrier wheel insert 100 (FIGS. 2 and 4) is insert molded in the first end portion 70 of the carrier body 60. The lower carrier wheel insert 100 is disposed below the drive teeth 74 and directly below the upper carrier wheel insert 80. The lower carrier wheel insert 100 is identical in construction to the upper carrier wheel insert 80.

A lower drive side guide roller 110 is supported for rotation on the lower carrier wheel insert 100. The lower drive side guide roller 110 is identical in construction to the upper drive side guide roller 90 and has a concave outer rolling surface 112. A sealed ball bearing (not shown) is molded within the roller 110. The roller 110 is rotatably secured in position on the insert 100, and thereby on the carrier body 60, by a bolt 114.

A pivot support pin 120 (FIG. 4) is insert molded in the second end portion 72 of the carrier body 60. The pivot pin 120 is made from a material such as aluminum. The pivot pin 120 has internally threaded upper and lower end portions 122 and 124 which project from the carrier body 60. The end portions 122 and 124 of the pivot pin 120 extend in a vertical orientation parallel to the base plane of the carrier body 60.

An upper pocket side guide roller 130 is supported for rotation about the upper end portion 122 of the pivot pin 120. The upper pocket side guide roller 130 is identical in construction to the drive side guide rollers 90 and 110 and has a concave outer rolling surface 132. A sealed ball bearing (not shown) is molded within the upper pocket side guide roller 130.

In assembly of the carrier 20, the upper pocket side guide roller 130 is placed over the projecting upper end portion 122 of the pivot pin 120. The inner race of the bearing in the upper pocket side guide roller 130 rests on a shoulder 134 on the carrier body 60. The upper pocket side guide roller 130 is secured in position relative to the carrier body 60 when the carrier 20 is connected with another carrier. This interconnection process can be described with reference to FIGS. 4 and 5 in regards to interconnecting the identical carriers 20 (FIGS. 4 and 5) and 20*a* (FIG. 5).

In the first step of this interconnection process, a nylon bearing 140 is inserted into the upper end of a cylindrical passage 142 in the carrier 20*a*. The bearing 140 is keyed to the carrier body 60 of the carrier 20*a* to prevent rotation of the bearing in the passage.

The carrier 20 is then moved to a position adjacent to the carrier 20*a* in which the passage 142 in the carrier 20*a* is aligned with the pivot pin 120 of the carrier 20. A tubular connecting stud 144 is inserted through the bearing 140 and through the passage 142 in the carrier 20*a*. The connecting stud 144 is smaller in diameter than the bearing 140 in the passage 142 in the carrier 20*a*. The connecting stud 144 bottoms out on the inner race of the bearing in the upper pocket side guide roller 130.

An externally threaded bolt 146 is inserted through the connecting stud 144, and through the open center of the bearing in the upper pocket side guide roller 130. The bolt 146 is screwed into the upper end portion 122 of the pivot pin 120 with the head of the bolt engaging an internal shoulder (not shown) on the connecting stud 44. The bolt 146 secures the connecting stud 144 to the pivot pin 120 and, thereby, to the carrier body 60 of the carrier 20. The inner race of the bearing in the roller 130 is captured between the connecting stud 144 and the carrier body 60 of the carrier 20. A retaining ring 148 on the connecting stud 144 limits vertical movement of the parts.

The upper pocket side guide roller 130, which is fixed to the outer race of its internal bearing, is thus supported for rotation about the connecting stud 144. The connecting stud 144, which is fixed for movement with the carrier 20, is freely rotatable within the bearing 140 in the carrier 20*a*. The axis of rotation of the upper side guide roller 130 is not parallel to the axis of rotation of the upper drive side guide roller 90.

In the same manner, a lower pocket side guide roller 150 is secured in position between the carrier 20 and the adjacent carrier 20*a*, by a lower connecting stud 152. The axis of rotation of the lower pocket side guide roller 150 is parallel to and co-extensive with the axis of rotation of the upper pocket side guide roller 130, and is not parallel to the axis of rotation of the lower drive side guide roller 110.

The carriers 20 and 20*a* are thus interconnected for movement along the rails 12 and 14. The pivot pin 120 defines a pivot axis 154 about which the carrier 20 is pivotable relative to the carrier 20*a* to enable movement of the interconnected carriers around curves in the loop 16. The pocket side guide rollers 130 and 150 are rotatable about the pivot axis 154.

A desired number of carriers 20 are interconnected in this manner and are mounted on the upper and lower guide rails 12 and 14 as described below. When the carriers 20 are supported on the guide rails 12 and 14, each upper drive side guide roller 90 (FIG. 2) is disposed above, and inward of (that is, in a direction toward the drive unit 30), the upper guide rail 12. The concave surface 92 of each upper drive side guide roller 90 engages the convex outer surface 12*a* of the upper guide rail 12. Each lower drive side guide roller 110 is disposed below, and inward of (that is, in a direction toward the drive unit) the lower guide rail 14. The concave surface 112 of each lower drive side guide roller 110 engages the convex outer surface 14*a* of the lower guide rail 14.

Each upper pocket side guide roller 130 is disposed above, and outward of (that is, in a direction toward the pocket 40) the upper guide rail 12. The concave surface 132 of each upper pocket side guide roller 130 engages the convex outer surface 12*a* of the upper guide rail 12. Each lower pocket side guide roller 150 is disposed below, and outward of (that is, in a direction toward the pocket 40) the lower guide rail 14. The concave outer surface of each lower pocket side guide roller 150 engages the convex outer surface 14*a* of the lower guide rail 14.

Each one of the carriers 20 is thus supported by four rollers 90, 110, 130 and 150 for rolling movement along the upper and lower rails 12 and 14. The train of interconnected carriers 20 is supported for rolling movement along the loop 16.

It should be understood that the pockets 40 are shown only schematically in the drawings. Each pocket 40 is made from light weight material such as plastic and has an upper mounting portion, indicated schematically at 160, which is engageable in the upper mounting slots 76 in a respective carrier body 60. Each pocket 40 has a lower mounting portion, indicated schematically at 162, which is engageable in the lower mounting slots 78 in a respective carrier body 60. The lower mounting portion 162 of the pocket 40 is spring loaded to enable easy on-off movement of the pocket relative to the carrier 20. A handle portion 164 on the pocket 40 facilitates removal of the pocket from the carrier 20.

The pockets 40 are cantilevered out from the carriers 20. As seen in FIG. 2, each pocket 40 is supported only at its right-hand side, on a respective carrier 20, and projects in a direction to the left as viewed in FIG. 2. The pockets 40 project from the carriers 20 in a direction away from the drive unit 30. When the carriers 20 move past one of the drive units 30, the drive belt 50 on the drive unit engages the drive teeth 74 on the carriers. The drive belt 50 drives the carriers 20, and thus the pockets 40, along the rails 12 and 14.

It should be understood that devices other than pockets can be mounted on the carriers 20. For example, saddles for receiving folded signatures oriented with their folded edges upward can be mounted on the carriers 20.

From the above description of the invention, those skilled in the art will perceive improvements, changes and modifications in the invention. Such improvements, changes and modifications within the skill of the art are intended to be covered by the appended claims.

Having described the invention, I claim:

1. A sheet material handling apparatus comprising:

an elongate guide rail;

a plurality of interconnected carriers supported on a first side of said guide rail for movement in a first direction along said guide rail; and a plurality of sheet material receivers for receiving and supporting sheet material, each one of said receivers being connected with and movable with a respective one of said carriers;

said carriers being disposed intermediate said receivers and said guide rail and said receivers being cantilevered out from said guide rail in a second direction transverse to said first direction.

2. An apparatus as set forth in claim 1 wherein each one of said carriers is supported by a first plurality of rollers on a first side of said guide rail and a second plurality of rollers on a second side of said guide rail.

3. An apparatus as set forth in claim 2 wherein said elongate guide rail comprises an upper rail and a lower rail, each one of said carriers being supported by at least two rollers engaging opposite sides of said upper rail and at least two other rollers engaging opposite sides of said lower rail.

4. An apparatus as set forth in claim 1 wherein said carriers are interconnected along pivot axes spaced from said guide rail in the second direction, said pivot axes being disposed intermediate said pockets and said guide rail.

5. An apparatus as set forth in claim 1 further comprising drive means adjacent to said guide rail, said drive means including a drive member engageable with drive surfaces on said carriers as said carriers move past said drive means for moving said carriers and thereby said receivers in said first direction along said guide rail.

6. An apparatus as set forth in claim 1 wherein said guide rail comprises an upper rail and a lower rail each made from tubular metal, said carriers being made from plastic and being supported by a first plurality of rollers on said upper rail and a second plurality of rollers on said lower rail, said pockets being made from plastic.

7. A sheet material handling apparatus comprising:

an elongate guide rail;

a plurality of interconnected carriers supported on a first side of said guide rail for movement in a first direction along said guide rail, each one of said carriers having a drive surface;

a plurality of sheet material receivers for receiving and supporting sheet material, each one of said receivers being connected with and movable with a respective one of said carriers, said carriers supporting said receivers for movement in said first direction along said guide rail; and drive means adjacent to said guide rail, said drive means including a drive member engageable with said drive surfaces on said carriers for moving said carriers and thereby said receivers in said first direction along said guide rail.

8. An apparatus as set forth in claim 7 wherein said drive member comprises an externally toothed drive belt driven for movement relative to said guide rail, said drive surfaces on said carriers comprising a plurality of drive teeth formed on each one of said carriers, said drive teeth on each one of said carriers being engageable by said drive belt as said one carrier moves past said drive means.

9. An apparatus as set forth in claim 8 wherein said guide rail comprises an upper rail and a lower rail, said drive belt being located vertically between said upper rail and said lower rail and being supported for movement in a direction along said rails.

10. An apparatus as set forth in claim 7 wherein said carriers are disposed intermediate said receivers and said guide rail and said receivers are cantilevered out from said guide rail in a second direction transverse to said first direction.

11. A sheet material handling apparatus comprising:

first and second elongate metal guide rails extending parallel to each other;

a plurality of interconnected plastic carriers each supported on said guide rails by a plurality of rollers for movement in a first direction along said guide rails; and a plurality of plastic sheet material handling members, each one of said sheet material handling members being connected with a respective one of said carriers and movable with said one carrier along said guide rails.

12. An apparatus as set forth in claim 11 wherein each one of said carriers has a drive surface, said apparatus further comprising drive located adjacent to said guide rails, said drive means including a drive member engageable with said drive surfaces on said carriers as said carriers move past said drive means for moving said carriers and thereby said sheet material handling members in said first direction along said guide rails.

13. An apparatus as set forth in claim 12 wherein said drive member is a externally toothed drive belt.

14. An apparatus as set forth in claim 11 wherein said carriers are disposed on a first side of said guide rails intermediate said sheet material handling members and said guide rails, said sheet material handling members being cantilevered out from said guide rail in a second direction transverse to said first direction.

15. An apparatus as set forth in claim 11 wherein each one of said guide rails has a cylindrical cross-sectional configuration, first and second ones of said plurality of rollers engaging said first rail on opposite sides of said first rail and being rotatable about respective non-parallel axes, third and fourth ones of said plurality of rollers engaging said second rail on opposite sides of said second rail and being rotatable about respective non-parallel axes.

* * * * *